US005837667A

United States Patent [19]

Stabley

[11] Patent Number: 5,837,667

[45] Date of Patent: Nov. 17, 1998

[54] ENVIRONMENTALLY SAFE DETERGENT COMPOSITION AND METHOD OF USE

[76] Inventor: Garth E. Stabley, 5055 S. Lindell Rd. No. 1104, Las Vegas, Nev. 89118

[21] Appl. No.: 877,573

[22] Filed: Jun. 17, 1997

Related U.S. Application Data

[60] Provisional application No. 60/020,952 Jun. 19, 1996.

[51] Int. Cl.[6] ..... C11D 1/825; C11D 3/30

[52] U.S. Cl. ..... 510/365; 510/422; 510/467; 510/499

[58] Field of Search ..... 510/422, 506, 510/365, 238, 499, 467, 241

[56] References Cited

U.S. PATENT DOCUMENTS

| | | | |
|---|---|---|---|
| 3,948,819 | 4/1976 | Wilde . | |
| 4,137,190 | 1/1979 | Chakrabarti et al. | 252/135 |
| 4,197,197 | 4/1980 | Abaeva et al. . | |
| 4,992,212 | 2/1991 | Corring et al. | 252/542 |
| 5,078,991 | 1/1992 | Birtwistle et al. . | |
| 5,124,077 | 6/1992 | Kajihara et al. . | |
| 5,719,113 | 2/1998 | Fendler et al. | 510/382 |

FOREIGN PATENT DOCUMENTS

| | | |
|---|---|---|
| 6-107984 A | 4/1994 | Japan . |
| 681134 | 8/1979 | U.S.S.R. . |
| 1066407 | 4/1967 | United Kingdom . |

OTHER PUBLICATIONS

Shell Development Co., Hard Surface Cleaners, Jul. 1979.

*Primary Examiner*—Paul Lieberman
*Attorney, Agent, or Firm*—Richard C. Litman

[57] ABSTRACT

A cleaning and sanitizing composition for use essentially on surfaces, but having other related utilities. The composition comprises a mixture in certain proportions of an anionic surfactant, a mixture of ethanolamines, two nonionic surfactants and a chelating agent in a water vehicle. The composition may further comprise a food grade preservative to enhance shelf-life at higher dilutions of the composition. The composition contains no inorganic builders or salts, nor inorganic bases or acids.

12 Claims, No Drawings

ENVIRONMENTALLY SAFE DETERGENT COMPOSITION AND METHOD OF USE

CROSS-REFERENCE TO RELATED APPLICATIONS

This application claims the benefit of U.S. Provisional Application Ser. No. 60/020,952 filed Jun. 19, 1996.

BACKGROUND OF THE INVENTION

1. Field of the Invention

The present invention relates to an environmentally safe detergent, or cleaning and sanitizing composition, for cleaning diverse surfaces. The composition is completely biodegradable and contains a mixture of nonionic surfactants, a phosphate ester anionic surfactant, a mixture of specific ethanolamines, water and a chelating agent.

2. Description of Relevant Art

In today's environmentally conscious society, it is particularly desirable to provide compositions which are useful for performing daily cleaning and sanitizing tasks and which also are biodegradable. This need has been met by many diverse types of cleaning compositions; however, each is generally suited for cleaning specific surfaces. Thus, there is a need to replace the many different kinds of cleaning agents useful for cleaning various kinds of surfaces with a single, universal cleaning composition that is effective, inexpensive, biodegradable and environmentally friendly.

Cleaning compositions comprising water, surfactants, emulsifiers, etc. for removing oily residues from surfaces are well known. British Pat. No. 1,066,407 to Unilever Limited discloses mixtures of nonionic surfactants, fatty acid and alkanolamine for use on metal surfaces. However, this disclosure does not describe a mixture of the specific nonionic surfactants of the present invention with an acid phosphate ester of an ethoxylated alcohol, an anionic surfactant.

A report by the Shell Chemical Co. describes the performance of various $C_9$–$C_{13}$ alcohol ethoxylates as hard surface cleaners. The performance was measured only against non-polar, oily soil on a non-polar, hydrophobic substrate.

A patent from the former Soviet Union, SU 681134 to Urals Chem. discloses a composition f or removing ink stains comprising mixtures of monoethanolamine and triethanolamine, mixed polyglycol esters of alkyl phenols, polypropylene glycol and an anionic surfactant. However, the patent does not show the combination of an acid phosphate ester, specific ethanolamine mixtures and specific nonionic surfactant mixtures.

U.S. Pat. No. 5,124,077 to Kajihara et al. discloses a skin detergent composition comprising a phosphoric acid ester surfactant and a water soluble chitin derivative. However, the patent does not provide teachings of the use of acid phosphate esters of ethoxylated alcohol, specific nonionic surfactants and specific mixture of ethanolamines for use in cleaning diverse surfaces.

U.S. Pat. No. 5,078,991 to Birtwistle et al. discloses a composition for skin treatment comprising a phosphate salt. There is no disclosure, however, of the use of other ingredients to arrive at a multi-utility cleaning composition.

U.S. Pat. No. 4,197,197 to Abaeva et al. discloses a dispersant for removing oil from water surfaces comprising the use of esters of hydroxyethylated higher aliphatic alcohols of phosphoric acid.

U.S. Pat. No. 3,948,919 to Wilde discloses a cleaning composition for aircraft comprising a mixture of nonionic surfactants having different mole amounts of ethylene oxide units per molecule.

Japanese Pat. No. 6-107984 to Yushiro Chem. Ind. shows a cleaning composition comprising mixtures of an ethanolamine with EDTA, anionic and nonionic surfactants and an aromatic alcohol. However, the patent does not teach the use of the specific nonionic surfactants and anionic surfactants with EDTA and a specific mixture of ethanolamines for use in multi-surface cleaning.

While the prior art may show the use of the various compounds I use in my invention for a cleaning composition, none of the patents or other disclosures teach my specific composition, nor provide any motivation for making my specific composition, and none of the above inventions and patents, taken either singly or in combination, describes my invention as claimed.

OBJECTS OF THE INVENTION

Accordingly, it is a principal object of my invention to provide a cleaning composition for various kinds of surfaces which is highly effective and substantially free from deleteriously effecting our environment on earth when used in a normal manner for cleaning.

It is another object of the invention to provide a universal cleaning or detergent composition comprising a mixture of an anionic surfactant, specifically an acid phosphate ester of an ethoxylated alcohol, two nonionic surfactants, namely ethylene oxide abducts of a $C_{11}$ linear primary alcohol, triethanolamine, monoethanolamine and a chelating agent, the forgoing being mixed with water as a solvent, carrier or vehicle.

It is a further object of the invention to provide a composition having wide utility, not only as a general cleaning agent, but also for use in soil redemption, and for use as a healing promoter for cuts and burns, due to the composition's sanitizing properties.

Still another object of the invention is to provide a cleaning composition that does not contain and is free from lower alkyl alcohols, phenols, solvent esters or ester-ethers such as, for example, butyl esters or glycols, for example, ethylene glycol monobutylether, hydrocarbon solvents, ethers, ketones, inorganic phosphates, silicates, borates, potassium or sodium hydroxide, and organic and inorganic acids, but which nevertheless is an effective and efficient cleaning agent, capable of substituting for several different detergents, each having specific cleaning properties or functions, for example.

It is an object of the invention to provide an improved, universal cleaning, sanitizing and soil reclamation composition for the purposes described which is inexpensive, dependable and fully effective in accomplishing its intended purposes.

These and other objects of the present invention will become readily apparent upon further review of the following specification.

DETAILED DESCRIPTION OF THE PREFERRED EMBODIMENTS

The present invention relates to a cleaning, sanitizing, soil reclamation, waste and water treatment composition. However, the composition is intended to function primarily as a detergent or cleaner for removing from many kinds of surfaces what is generically referred to as dirt, namely: synthetic and natural oil residues, grease, fat residues, the partial thermal decomposition products thereof and other organic and inorganic residues, deposits or coatings and mixtures thereof.

A few of the surfaces upon which my composition is effective, for example, include: wood, fine fabrics, polymethyl methacrylate polymer and plastic, stainless steel, gold, silver, brass, copper aluminum and glass. Depending upon the dilution ratio with water from the concentrated formula, other applications for cleaning or removing unwanted residues, for example, include: fruits and vegetables, automobile exteriors and interiors, bowling ally lanes, carpets, showers, tubs, slot machine surfaces, cooling tower scale removal, swimming pools, tile, mirrors, clothing, canvas, leather, rust removal, white walled tires, machinery and woodwork. With respect to fine fabrics, or colored or dyed cloth, however, it is to be noted that the use of my composition at full strength, the concentrate, that is, without dilution with water, to clean these materials, may result in some of the dye or color in the fabric either being removed or chemically altered.

More specifically, my invention composition may comprise any of three different forms. In this disclosure the expression "active ingredient" means an ingredient other than water which functions as an emulsifying agent, surface active agent, wetting agent, detergent, base, chelating agent, coupling agent or water solubility or miscibility enhancing agent. The term "base" refers to compounds classified as such in the ordinary chemical sense.

One form of my invention is a composition comprising only the active ingredients, or raw mixture. Another form is a composition comprising the active ingredients, an amount of water to make a concentrate or concentrated mixture of active ingredients in solution with water, and optionally a preservative. The third form of my invention is a diluted composition, wherein the concentrated solution is further mixed with up to ten times or more of water. In the form of a diluted composition, it is particularly desirable to include a preservative in order to prevent microbial activity against the composition.

Insofar as the raw mixture of only or essentially only the active ingredients is concerned, the composition comprises the following ingredients in the weight proportions given based on the total weight of the composition:

a: from 3 to 4% of a chelating agent such as, for example, ethylene diamine tetrasodium acetate (EDTA)

b. from 21.5 to 30.5% of an anionic surfactant-coupling agent, for example, an acid phosphate ester of an ethoxylated alcohol c. from 28.5 to 31.5% of a nonionic surfactant, for example, a $C_{11}$ linear primary alcohol ethoxylate having an average of 7 moles of ethylene oxide units d. from 9 to 10.5% of a nonionic surfactant, for example, a $C_{11}$ linear primary alcohol ethoxylate having an average of 3 moles of ethylene oxide units e. from 14 to 16.5% of an organic amine containing base, for example, monoethanolamine (MEA)

d. from 14 to 16.5% of an organic amine containing base, for example, triethanolamine (TEA)

Although EDTA has been provided as an example of a suitable chelating agent, other chelating agents may be substituted therefor.

The raw composition may be made by mixing the materials in a suitable container with the addition of sufficient heat to lower the viscosity of the ingredients in liquid form, and thus lower the amount of energy for the physical mixing process. Some of the raw materials or ingredients are obtained from suppliers and manufacturers in a liquid form which is quite viscous, thus heat may be applied to the container in which they are supplied to enable more efficient transfer from the supply container to mixing container. The above composition of raw ingredients, without water is used as a composition for making a cleaning composition when it is mixed with water.

The above composition may be made as a water solution concentrate. This is the second form of my invention. The water used, in order to make a composition of high quality, which possesses very reproducible results from batch to batch, should be distilled water or deionized water. If not, the water used should not contain excessive inorganic salt content, particularly salts of divalent metal ions. In this respect, the composition comprises the following ingredients in weight percent, based on total weight:

a. from 78 to 82% water b. from 0.5 to 8.5% chelating agent c. from 4.0 to 5.5% phosphate ester anionic surfactant d. from 5.0 to 6.5% nonionic surfactant, ethoxylated primary alcohol having an average of 7 moles of ethylene oxide units e. from 1.0 to 2.5% nonionic surfactant, an ethoxylated alcohol having an average of 3 moles of ethylene oxide units f. from 2.5 to 3.5% of monoethanolamine g. from 3.0 to 4.5% of triethanolamine This concentrate composition may be made by mixing the ingredients in a specific order and manner into an appropriate amount of water. It is particularly important to begin the mixing operation by first mixing into water the chelating agent. A convenient container for mixing and storing the composition may be a 55 gallon drum, for example. The concentrate composition may additionally include a preservative, preferably a food grade preservative having sufficient activity as an antibacterial agent. It is particularly useful to include such a preservative in the concentrate composition if it is intended for consumer use in a diluted form, discussed hereinafter, which will be required to have a significant shelf-life.

The diluted composition may be made by the consumer or user depending upon the cleaning application under consideration. For example, to clean fruits and vegetables, a suitable dilution ratio is one-fourth teaspoon concentrate composition to one pint water. A suitable dilution ratio for cleaning showers (tile), walls, furniture, automobile exteriors and interiors, upholstery, woolens, silks, nylons or fine fabrics would be 15 parts water to 1 part concentrate composition. For glass surfaces 100 parts water to 1 part concentrate composition. For removing scale from cooling towers, use of the concentrate composition at full strength is appropriate.

My composition may also be used in ordinary washing processes for clothing. For example, one volume of normal liquid or powdered washing machine detergent may be mixed with ½ volume of my concentrate composition.

Regarding the method of use, it is conventional in the detergent arts insofar as the steps are concerned. For hard surfaces, the composition is applied to such surface either directly or through the agency of a solid carrier device, for example, a cloth, synthetic fabric, sponge, brush or other device capable of retaining the composition in contact therewith, the surface of which is substantially lower in hardness (MOHS) than the surface to be cleaned. Whether or not the composition is applied directly or through the agency of a carrier device, the composition in contact with the surface to be cleaned is combined with the frictional action of an applicator or carrier device. The combination of frictional forces and the chemical, surfactant and emulsifying properties possessed by the composition act to remove unwanted oily or fatty residues from surfaces.

In my compositions the most preferred embodiment comprises a composition containing ethylene diamine tetrasodium acetate (EDTA) as a chelating agent. The phosphate ester is preferably a compound such as a-hydro-w-hydroxy-mono-alkyl ether phosphate (CAS #68909-65-9), sold under the tradename Norfox PE600 and available from Norman, Fox & Co. The nonionic surfactants are preferably ethylene oxide adducts of a $C_{11}$ primary alcohol, namely a-undecyl-w-hydroxypoly(oxy-1,2-ethanediyl), one having an average of seven moles of ethylene oxide units and the other having an average of three moles of ethylene oxide units. Two exemplary surfactants are sold under the tradename Neodol 1-3 and Neodol 1-7, both of which are available from Shell Chemical Co. One example of a suitable antibacterial, food grade preservative is available under the tradename DOWICIL 75 from Van Water & Rogers, Inc., a subsidiary of Univar (Kirkland, Wash.). The ingredients of DOWICIL 75 are: 1-(3chloro-2-propenyl)-3,5,7-Triaza-1-azoniatricyclo [3.3.1.1$^{3,7}$]decane chloride (CAS #004080-31-3), 69%; sodium bicarbonate (CAS #000144-55-8), 25%; and hexamethylenetetramine hydrochloride (CAS #058713-21-6), 4%. Further, I intend that my composition include minor amounts of other ingredients such as, for example, colorants, fragrances or odor enhancing agents, and other materials that function to provide my composition with resistance to degradation or decomposition resulting from oxidation or radiant energy, for example. Additionally, in respect to the monoethanolamine component, for some cleaning applications, this material may be omitted entirely and replaced with an equivalent amount of triethanolamine. However, against all types of soils for which my composition is intended, such modified compositions are not as effective as are compositions containing both monoethanolamine and triethanolamine.

The examples of preferred embodiments presented herein are for illustration and the invention is not to be construed as being limited thereto as set forth above, but it encompasses any and all embodiments within the scope of the following claims. Further, my invention includes the substitution of functionally equivalent materials for any and all of the ingredients I use in the sense that any material or ingredient capable of producing substantially identical functional properties, including cooperative synergistic properties, is usable in place of any of the materials of my invention. The effectiveness and efficiency with which the disclosed compositions function is due to the properties each of the ingredients possesses, in general, and are not necessarily due to the materials themselves.

It is to be understood that the present invention is not limited to the embodiments described above, but encompasses any and all embodiments within the scope of the following claims.

I claim:

1. A cleaning composition for use essentially on solid surfaces, the cleaning composition comprising water, a linear primary alcohol ethoxylate mixture, an acid phosphate ester of an ethoxylated alcohol, a chelating agent and a mixture of monoethanolamine and triethanolamine in approximately equal amounts.

2. The cleaning composition according to claim 1, wherein said linear primary alcohol ethoxylate mixture includes a $C_{11}$ linear primary alcohol ethoxylate having an average of 7 moles of ethylene oxide units, and a $C_{11}$ linear primary alcohol ethoxylate having an average of 3 moles of ethylene oxide units.

3. The cleaning composition according to claim 1, wherein said acid phosphate ester of an ethoxylated alcohol is a-hydro-w-hydroxy-mono-alkyl ether phosphate.

4. The cleaning composition according to claim 1, wherein said chelating agent is ethylene diamine tetrasodium acetate (EDTA).

5. The cleaning composition according to claim 1, wherein said mixture of monoethanolamine and triethanolamine includes monoethanolamine and triethanolamine present in a weight ratio of about 1:1.13 respectively.

6. The cleaning composition according to claim 1, further comprising an antibacterial, food grade preservative.

7. The cleaning composition according to claim 6, wherein said an antibacterial, food grade preservative is a mixture of 1-(3-chloro-2-propenyl)-3,5,7-Triaza-1-azoniatricyclo[3.3.1.1$^{3,7}$]decane chloride, sodium bicarbonate, and hexamethylenetetramine hydrochloride.

8. The cleaning composition according to claim 1, comprising the following ingredients in percent by weight based on the total weight of the composition:

a. between about 78–82% water, b. between about 0.5–8.5% tetrasodium ethylene diamine tetraacetate, c. between about 4.0–5.5% of a poly(oxy-1,2-ethanediyl), a-hydro-w-hydroxy-mono-$C_{10-16}$-alkyl ether phosphate, d. between about 5.0–6.5% of an a-undecyl-w-hydroxypoly(oxy-1,2-ethanediyl), having an average of 7 moles of ethylene oxide units per mole of compound, e. between about 1.0–2.5% of an a-undecyl-w-hydroxypoly(oxy-1,2-ethanediyl) having an average of 3 moles of ethylene oxide units per mole of compound, f. between about 2.5–3.5% of monoethanolamine, and g. between about 3.0–4.5% of triethanolamine.

9. The cleaning composition according to claim 1, consisting of the following ingredients in percent by weight based on the total weight of the composition:

a. about 80% water, b. about 0.7% tetrasodium ethylene diamine tetraacetate, c. about 4.4% of a poly(oxy-1,2-ethanediyl), a-hydro-w-hydroxy-mono-$C_{10-16}$-alkyl ether phosphate, d. about 5.9% of an a-undecyl-w-hydroxy-poly(oxy-1,2-ethanediyl), having an average of 7 moles of ethylene oxide units per mole of compound, e. about 1.8% of an a-undecyl-w-hydroxy-poly(oxy-1,2-ethanediyl) having an average of 3 moles of ethylene oxide units per mole of compound, f. about 3.0% of monoethanolamine, and g. about 3.4% of triethanolamine.

10. A method of removing unwanted oily, fatty, organic and inorganic residues from a solid surface, the method comprising:

providing a cleaning composition comprising water, a linear primary alcohol ethoxylate mixture, an acid phosphate ester of an ethoxylated alcohol, a chelating agent and a mixture of monoethanolamine and triethanolamine in approximately equal amounts; and applying the cleaning composition to a solid surface.

11. The method according to claim 10, further comprising the step of:

frictionally contacting the solid surface with an applicator, the applicator retaining the cleaning composition.

12. The method according to claim 10, wherein the cleaning composition being provided consists of the following ingredients in percent by weight based on the total weight of the composition:

a. about 80% water, b. about 0.7% tetrasodium ethylene diamine tetraacetate, c. about 4.4% of a poly(oxy-1,2-ethanediyl), a-hydro-w-hydroxy-mono-$C_{10-16}$-alkyl ether phosphate, d. about 5.9% of an a-undecyl-w-hydroxy-poly(oxy-1,2-ethanediyl), having an average of 7 moles of ethylene oxide units per mole of compound, e. about 1.8% of an a-undecyl-w-hydroxy-poly(oxy-1,2-ethanediyl) having an average of 3 moles of ethylene oxide units per mole of compound, f. about 3.0% of monoethanolamine, g. about 3.4% of triethanolamine.

* * * * *